US005462001A

United States Patent [19]

Lemelson

[11] Patent Number: 5,462,001

[45] Date of Patent: Oct. 31, 1995

[54] TOWED WATERCRAFT AND STEERING METHOD

[76] Inventor: Jerome H. Lemelson, P.O. Box 5076, Incline Village, Nev. 89450

[21] Appl. No.: 346,199

[22] Filed: Nov. 22, 1994

[51] Int. Cl.[6] ..... B63B 21/04

[52] U.S. Cl. ..... 114/253; 441/65; 441/79; 114/144 R

[58] Field of Search ..... 441/65, 66, 67, 441/74, 79; 114/39.2, 144 R, 153; 440/7

[56] References Cited

U.S. PATENT DOCUMENTS 2,910,708 11/1959 Albright ..... 441/65
4,708,675 11/1987 Shoeffler et al. ..... 441/79
4,883,436 11/1989 Oakland ..... 441/65
5,076,189 12/1991 Jones ..... 441/65
5,247,898 9/1993 Thornlimb ..... 441/65
5,362,269 11/1994 Leach ..... 441/65

*Primary Examiner*—Stephen Avila
*Attorney, Agent, or Firm*—Ronald R. Snider

[57] ABSTRACT

A pullable, steerable watercraft is operable to be towed behind a power boat of kite. The watercraft has a steering mechanism within the watercraft body, and has a dome-shaped steering control recessed into the top surface thereof. The steering mechanism includes a movable mechanical shaft or arm which extends through the interior of the watercraft and which pivots about a vertical axis in order to rotate a rudder.

20 Claims, 4 Drawing Sheets

TOWED WATERCRAFT AND STEERING METHOD

BACKGROUND OF THE INVENTION

1. Field of the Invention

This invention is in the field of recreational watercraft pulled by motor boats, jet skis, or other powered water craft. Such watercraft are used for both entertainment and sport.

2. Prior Art

The prior art includes watercraft which carry a human being and are towed behind a motor boat. These include water skis, a single water ski, a surfboard, and other similar shaped boards. These prior art devices are controlled by shifting the weight of the user, and such control depends upon the ability of the passenger to stand on the craft and shift weight and varies with the speed of the motor boat.

SUMMARY OF THE INVENTION

This invention relates to a watercraft having positive manual steering capability, which watercraft is intended to be pulled behind a power boat at the end of a rope, preferably twenty-five to seventy-five feet in length. Such watercraft may be adapted to carry one or more persons, preferably in a prone position facing the direction of travel.

The invention is particularly concerned with an effective steering mechanism for the towed watercraft, which will permit it to be steered or guided by a person lying thereon, across and on either side of the wake behind the powered boat. By operating the steering mechanism by hand, the person on the watercraft may perform various maneuvers for pleasure or competitive sport.

In a preferred form, the watercraft is configured either as a relatively flat, slab-shaped raft or a shallow boat with a flat or specially shaped bottom surface permitting it to travel through water with minimum resistance. The upper surface thereof is shaped to accommodate one or more persons. Such craft may also be designed to accommodate a person or persons sitting thereon.

Since the craft may be subject to substantial bouncing and may cause the rider to bend or fall forward on the upper surface thereof, such surface is preferably relatively flat or contoured and cushioned to prevent injury.

A steering mechanism is provided which contains a shaft or other actuating assembly extending through the interior of the raft or hull, or a cavity in the undersurface thereof. The interior extending mechanism is preferable to protect the rider from injury resulting from body or hand contact with such mechanism or the mechanism from being snagged by water-borne articles.

In a preferred embodiment, such steering mechanism initiates at or above the upper surface of the craft, preferably with a ball or dome shaped soft plastic or rubber gripper or handle which a person lying and facing forward on the craft may grip by hand and pivot or swing from one side to the other to effect steering by the forced movement of a rudder or pair of rudders located beneath the craft body or behind same. Such rudder or rudders are preferably made of plastic and may be connected to the steering mechanism described by means of a shaft, lines, tubing, or molded plastic components which are safely supported within the hull and therefore cannot cause injury to the user of the craft or become damaged in the event that it is tipped over, up-ended, or the craft strikes solid objects during its operation.

Accordingly, it is a primary object of this invention to provide a new and improved watercraft for sports and recreational use when it is towed behind a powered boat.

Another object is to provide a towable watercraft for sports and recreational use, which may be controllably maneuvered and steered during its forward travel as it is towed.

Another object is to provide a new and improved steering mechanism for watercraft.

Another object is to provide a new and improved steering mechanism for watercraft having a steering arm with a handle which is shaped and recessed within a curved receptacle or channel in the upper wall of the craft and is thereby safe to use without the danger of injury to the user in the event that the craft severely bounces, tips over or up-ends during use.

With the above and other such objects in mind, the invention will be better understood and become more apparent when consideration is given to the following detailed description thereof, which makes reference to the annexed drawings now described.

DETAILED DESCRIPTION

Figure 1:
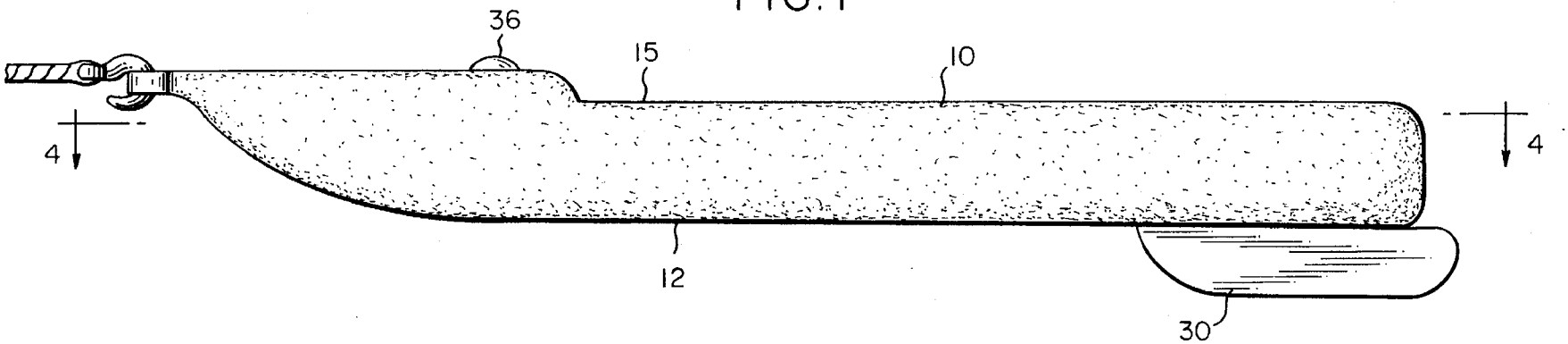
FIG. 1 shows a side view of the watercraft in the preferred embodiment.
Figure 2:
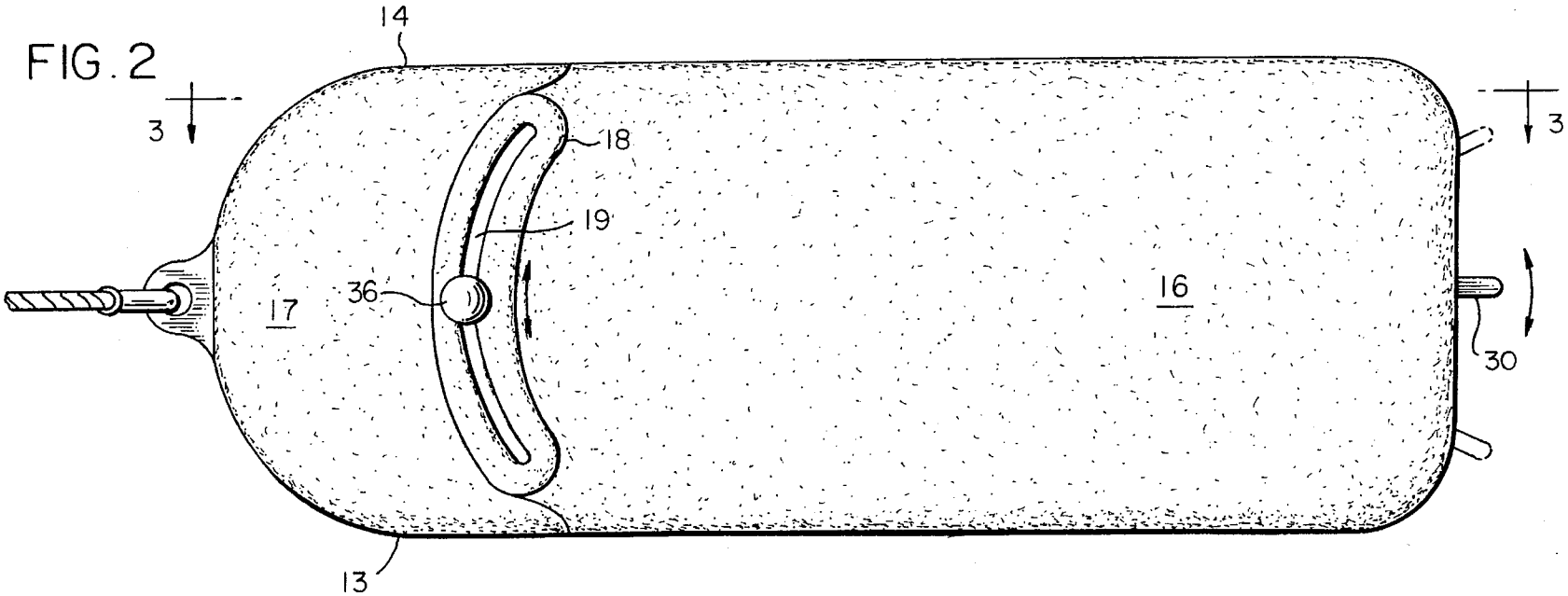
FIG. 2 shows a top view of the watercraft, depicting part of the steering mechanism of the craft including a steering handle recess in the top wall and a depression in which a person's body may lie.
Figure 5A:
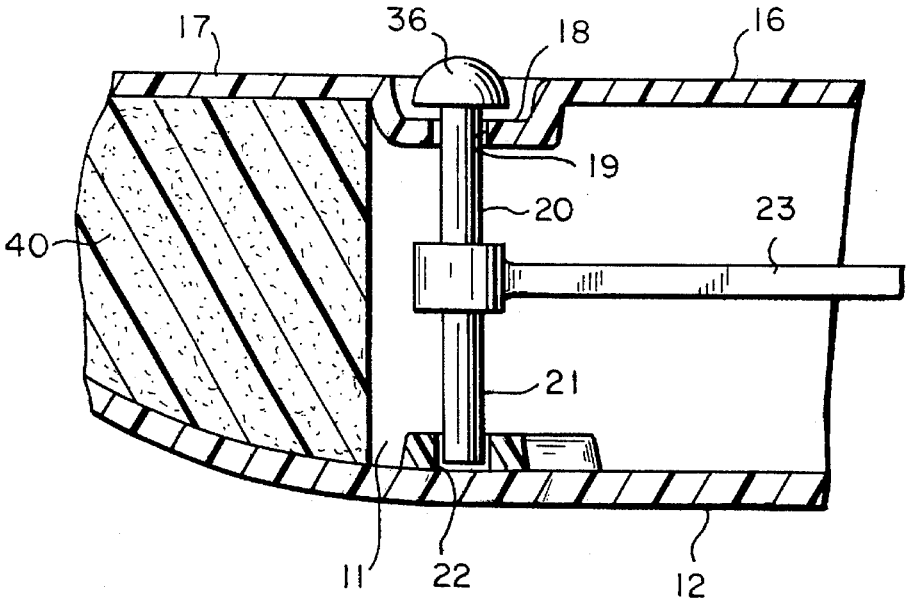
FIG. 5A shows a side view of the steering mechanism 20 where the handle 21 rides in slot 22.

In FIGS. 1 and 2 are shown details of a towable watercraft, such as a raft or shallow boat 10 which is adapted to be pulled behind a powered boat on the end of a long flexible line or rope. In the embodiment shown, the watercraft 10 is formed of a slab-like hull 12, the bottom wall 12 of which may be flat or have the shape illustrated with curved left and right wall portions 13 and 14 conforming to that of a shallow boat hull or pontoon. The top wall 15 of the hull 12 may be flat or slightly concave to conform to the body of a person lying thereon facing forward. Accordingly, a portion 16 of the top wall 15 is concavely shaped downward while a front portion 17 of such top wall is relatively flat or otherwise smoothly contoured with the exception of a narrow channel 18 formed in the upper wall 15 to accommodate the upper portion or head 36 of the handle 21 in order to hand operate the steering mechanism 20 of the craft. Such portion 36 rides laterally an arcuate slot 19 formed in the bottom wall of the cavity or channel 18 as shown in FIG. 5A.

To accommodate the steering mechanism which employs a pivoted handle 21, as in the embodiment of FIGS. 1 and 2, the arcuately extending channel 18 permits left and right directional movement of the handle therein in the act of steering the craft and by moving the steering rudder 30 in an arcuate or pivotal movement clockwise and counter clockwise to effect such steering.

Figure 3:
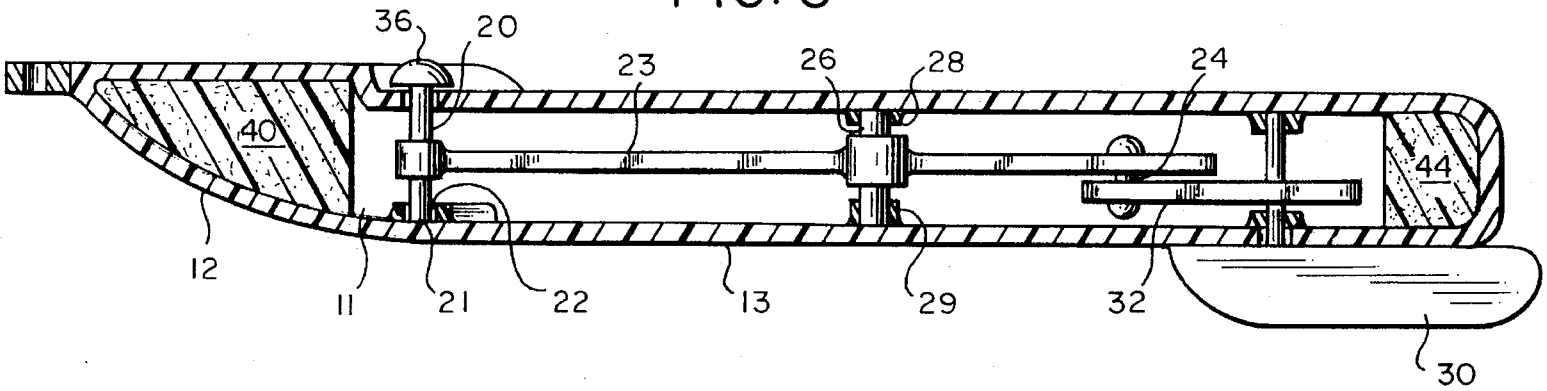
FIG. 3 shows a side cross-sectional view taken along the center line of FIG. 2.
Figure 4:
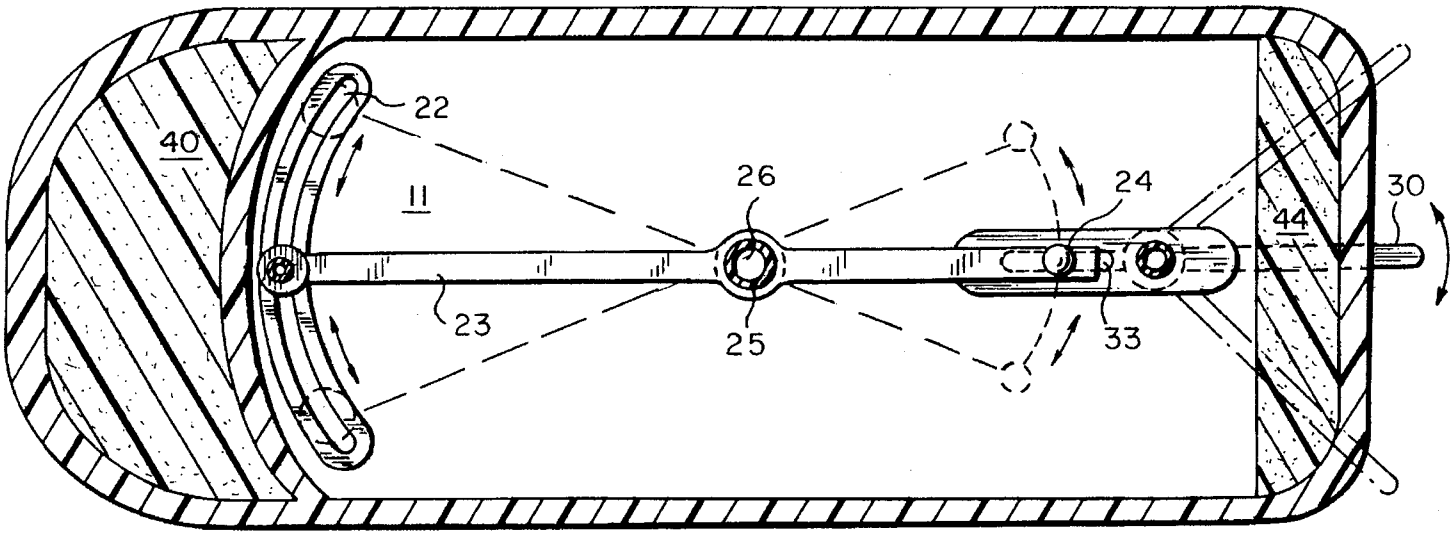
FIG. 4 shows a cross-sectional view taken along the line 4—4 in FIG. 1.

The steering mechanism 20 in the embodiment of FIGS. 3 and 4 includes a long pivoted arm 23 which is pivotally supported between its ends by a pin 26 extending through a hole 25 in the central portion of the arm between the ends thereof, which pin is supported by suitable anchor means in the form of receiving cavities or dimples 28 and 29 formed in select portions of the opposite top and bottom walls of the hull or body 12 of the craft which may retain fittings, such as bushings, secured therein.

The aft end of arm 23 contains a pin 24 which rides in an elongated slotted opening or passageway 33 in an extension 32 of the rudder 30 or a bracket connected thereto.

Grip 36 is a soft ball-shaped handle which may be gripped by a hand of the person riding the craft 10 and used to pivot or operate the steering mechanism as described. The handle 21 is connected to the forward end of arm 23 by a ball joint. The bottom end of handle 21 slides along the bottom wall 12 so that it can pivot laterally, thereby rotating arm 23. The handle 21 is guided by an arcuate cavity and slotted opening 22 in the top wall 16 of the hull 12.

Variations in the watercraft structure and its steering mechanism described above are noted as follows:

1. The ball-shaped grip or handle 36 for the steering mechanism 20 may be made of rubber or other soft plastic, or a yieldable cellular plastic configured to provide the desired steering functions without posing a hazard to the rider of the craft in the event that the rider's face or body is thrown suddenly against the handle during the operation of the craft.

2. The steering mechanism described above may be constructed to increase its mechanical advantage and/or to reduce friction during its operation or to provide sufficient tension therein for suitable steering and operation of the craft when towed behind a motor or engine powered boat. In this respect, plastic bearings or sealed lubricant bearings may also be provided between the pivoted and moving parts of the steering assembly.

3. Fewer or more pins may be employed in the steering mechanism to effect suitable mechanical advantage and/or improve the steering action of the watercraft. Attachment of pivoted parts of such mechanism may be to the top and bottom walls of the plastic hull or body. Such attachment may also be effected by molding, staking or heat-sealing.

Figure 7:
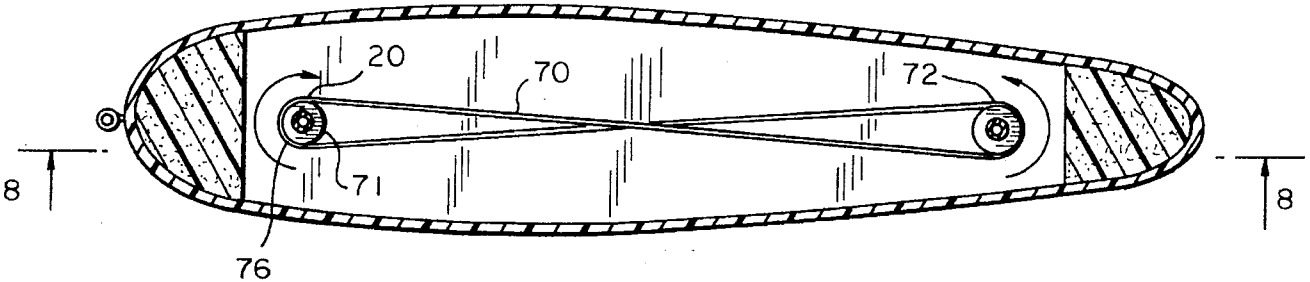
FIG. 7 shows an alternate embodiment where control of a steering rudder is effected by means of a pulley assembly.
Figure 8:
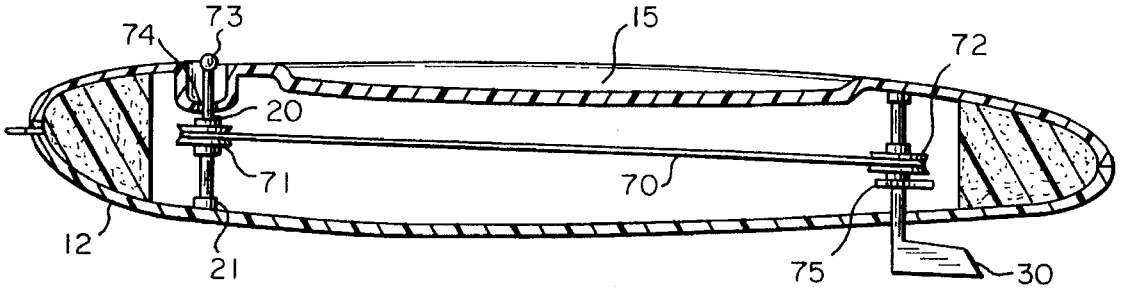
FIG. 8 shows a side view of the alternate embodiment of FIG. 7.

4. FIGS. 7 and 8 show an embodiment where one or more parts of the steering mechanism may be made of flexible cable 70, rope or molded plastic material extending, for example, between the handle end 21 of the mechanism and the pivoted rudder 30 or rudders along the bottom of the craft or at the rear thereof. Such flexible members may extend over and around one or more pulleys 71, 72 or wheels for guiding same from the crank 76 or actuating end of the mechanism to the rudder assembly 75.

5. The steering mechanism may utilize a more complex assembly of linkages and cranks with or without gears, such as plastic gears, to attain suitable mechanical advantage and overcome friction during the steering operation.

6. A selected portion or portions of the interior 11 of the body of the watercraft 10 may be formed of or filled with flexible and/or rigid plastic foam or cellular material (40,44) to provide flotation ballast and/or support for the opposite walls 12 and 15 of the watercraft 10. To attain such structure, one or more ribs may be formed and extend inwardly from the opposite walls so as to stiffen same and/or make contact with the opposite wall to divide the hollow body into a plurality of chambers, one or more of which may accommodate the steering mechanism while one or more of the other chambers may contain the described flexible or rigid cellular plastic materials.

7. The watercraft body 10 may be molded in one piece by blow-molding or rotational molding wherein at least a portion, if not all of the steering mechanism, is operatively secured at one or more locations to the molded material by such molding.

8. The watercraft 10 may be also formed of two or more hull components which are injection molded of suitable rigid plastic and are secured together by adhesive, solvent bonding, ultrasonic or another form of welding.

9. By relying on one or more pads 40, 44 of closed cell flexible or rigid plastic disposed within the interior 11, for flotation or by the injection and formation of a closed cell cellular plastic floatation material within one or more closed chambers of the one piece molding or assembly, the need to totally seal the interior 11 of the watercraft 10 from water leaking therein is eliminated.

Figure 5B:
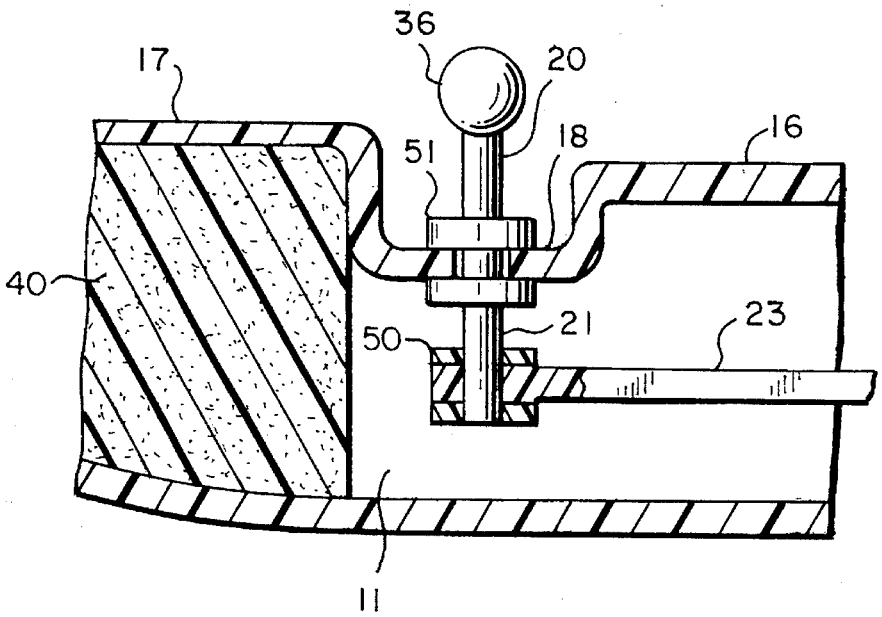
FIG. 5B shows a side view of an alternative embodiment where the handle 21 is retained by sliding engagement with slot 18 and is not in contact with the bottom of the water craft.

10. FIG. 5B shows an alternate embodiment wherein a pair of washers 50, 51 are fixed on steering rod 21 to allow the slot 19 in the bottom wall of depression 18 to act as the guide for rod 21 without use of the arcuate channel 22 of FIG. 3 provided along 22 at the bottom wall 13 of the hull 12.

Figure 6:
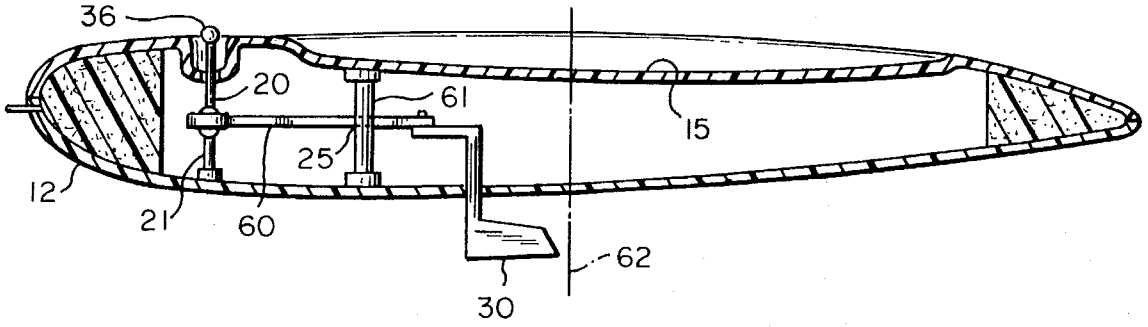
FIG. 6 shows an alternate embodiment where the rudder is placed forward of the watercraft's center of resistance.

11. FIG. 6 shows an alternative embodiment where the rudder 30 is moved forward of the center of resistance 62 of the water craft. To accommodate this design, arm 60 is made shorter than the arm 23 shown in FIGS. 3 and 4. The pin 61 holds the arm 60 in the same manner as the pin 26 holds arm 23 in FIG. 3.

While a detailed description of the present invention has been provided above, the present invention is not limited thereto, but rather is defined by the following claims.

What is claimed is:

1. A watercraft operable to be towed behind a powered boat comprising:

(a) a craft body configured to receive and provide floatation for at least one human being;

(b) an upper surface of said craft body configured to permit a human being to be supported thereon in a lying position, facing forward when the watercraft is operatively towed in water;

(c) a steering mechanism supported by said craft body and including at least one steering rudder located along the length of said body and extending beneath said body, and mechanical means including a connecting rod extending through said body and connected to said rudder for varying the angle of said rudder with respect to a longitudinal axis of said water craft in a manner to permit a person riding said watercraft to controllably seer said watercraft;

(d) said steering mechanism including a steering handle moveable in an arc to the left and right of said longitudinal axis to move said connecting rod for varying the angle of said rudder; and (e) means including a towing line secured to said watercraft and extending to a powered boat for towing said watercraft through the water behind said boat wherein said steering mechanism may be manually operated to cause the towed watercraft to move to the left or right in the water within and beyond the wake of said powered boat.

2. A watercraft in accordance with claim 1 having a dome-shaped gripping member secured to said steering handle to be hand gripped by a person riding on said body to steer said watercraft and wherein said dome-shaped gripping member is configured so as to not cause injury to the face or body of a person riding said craft if such person's face or body is caused to impact suddenly therewith.

3. A watercraft adapted to be towed on the end of at least one flexible line which is greater than 20 feet in length behind a powered vehicle and is maneuverable there behind, comprising in combination:

(a) a craft body defining an assembly capable of floating on water and capable of being towed with at least one person supported on the upper surface thereof;

(b) a steering mechanism including a rudder pivotally supported near an aft end of said body, moveable mechanical means extending through said body to a rear end from a forward end of said body and connected to pivotally operate said rudder for steering said watercraft, (c) said craft body formed of top and bottom walls space-separated from each other and defining a space therebetween containing said moveable mechanical means, (d) an elongated slotted opening in said top wall of said craft body near the forward end thereof, and (e) said steering mechanism including a handle supported above said slotted opening, and a connection between said handle and said mechanical means extending through said body, said handle being operable to permit it to be grasped by a person steering said watercraft and to be moved bi-directionally along the path defined by said slotted opening so as to permit the operation of said steering mechanism and wherein said rudder is caused to pivot back and forth in the act of steering said watercraft in its travel through the water.

4. A watercraft in accordance with claim 3 having a deformable member secured to said handle and extending above said top wall of said craft body and shaped to be gripped by the hand of a person riding said watercraft said handle being movable in a manner to permit such person to effect the movement of said rudder and to variably steer said watercraft through the water as it is towed behind the boat.

5. A watercraft in accordance with claim 4, wherein said deformable member has a dome shaped upper surface.

6. A watercraft in accordance with claim 5, wherein said deformable member is made of a flexible material selected from the group including rubber and elastomeric polymers.

7. A watercraft in accordance with claim 4, wherein said deformable member is in the shape of a small sphere which is grippable in the hand of a person riding said watercraft.

8. A watercraft in accordance with claim 3 wherein the top wall of said body contains an elongated cavity formed therein near the forward end of said body, said elongated slotted opening being formed in the bottom wall of said cavity, said deformable member being configured and secured to said mechanism to travel above and along said elongated cavity.

9. A watercraft in accordance with claim 5, wherein the top wall of said body contains an elongated cavity formed therein near the forward end of said body, said elongated slotted opening is formed in the bottom wall of said cavity, and said deformable member is configured and secured to said steering mechanism to travel above and in alignment with said elongated cavity.

10. A watercraft in accordance with claim 3, wherein said cavity and said elongated slotted opening in the top wall of said body have arcuate shapes.

11. A watercraft in accordance with claim 3, wherein said cavity and said elongated slotted opening in the top wall of said body have linear shapes.

12. A watercraft in accordance with claim 3, wherein said steering mechanism includes at least one elongated arm and means for pivotally supporting said arm between the top and bottom walls of said body.

13. A watercraft in accordance with claim 12, including means for linking said arm to said rudder to permit said arm to pivotally move said rudder about an arc.

14. A watercraft comprising in combination:

(a) a watercraft body operable to float on water with at least one person supported by said body above water, said body having an upper half, and an arcuate opening in said upper wall, (b) a steering mechanism partly supported within the confines of said watercraft body and including a hand grip guided in movement through said arcuate opening extending above at least a portion of an upper surface of said body and located near a forward end of said watercraft body, said hand grip being moveable laterally left and right by hand;

(c) said steering mechanism including a rudder pivotally supported by said body and protruding downward therefrom into the flow of water beneath said body when said watercraft is towed behind a powered boat; and (d) said steering mechanism being operable when said hand grip is moved to the left and right by a person supported on the upper surface of said body to cause said rudder to be pivotally moved clockwise and counter clockwise in a manner to effect the steering movement of said watercraft to the left or right.

15. A watercraft in accordance with claim 14, wherein said steering mechanism comprises at least one rigid arm pivotally supported by said body and operable to be pivoted in an arc by the left and right movement of said hand grip by a person riding said watercraft as it is towed behind a powered boat.

16. A watercraft in accordance with claim 3, wherein said body has a concave upper surface which may conform to a human body.

17. A watercraft in accordance with claim 3, wherein said body contains foamed flotation material.

18. A watercraft in accordance with claim 3, wherein said body contains strengthening rib formations.

19. A watercraft in accordance with claim 3, wherein said rudder is located forward of a longitudinal center of resistance of said watercraft.

20. A watercraft in accordance with claim 3, wherein said rudder is located aft of a longitudinal center of resistance of said watercraft.

* * * * *